US005228559A

United States Patent [19]

Demissy

[11] Patent Number: 5,228,559

[45] Date of Patent: Jul. 20, 1993

[54] SECTION SWITCH THAT OPENS SUDDENLY

[75] Inventor: Daniel Demissy, Montreal, Canada

[73] Assignee: Gec Alsthom Energie Inc., Laprairie, Canada

[21] Appl. No.: 863,074

[22] Filed: Apr. 3, 1992

[30] Foreign Application Priority Data

Apr. 8, 1991 [FR] France ..... 91 04251

[51] Int. Cl.[5] ..... H01N 31/30

[52] U.S. Cl. ..... 200/48 A; 200/48 KB

[58] Field of Search ..... 200/48 A, 48 KB, 48 V, 200/48 SB, 48 CB, 48 P, 48 R, 146 R

[56] References Cited

U.S. PATENT DOCUMENTS

| | | | |
|---|---|---|---|
| 1,919,065 | 7/1933 | Jacobs . | |
| 2,436,296 | 2/1948 | Graybill et al. . | |
| 2,779,830 | 1/1957 | Turner et al. | 200/48 A |
| 2,897,323 | 7/1959 | Krase et al. . | |
| 2,988,610 | 6/1961 | Bernatt | 200/48 A |
| 3,148,260 | 9/1964 | Upton . | |
| 3,175,054 | 3/1965 | Schwager et al. | 200/48 A |
| 3,235,694 | 2/1966 | Thallner | 200/146 R |
| 3,388,225 | 6/1968 | Foti | 200/48 A |

FOREIGN PATENT DOCUMENTS 3235379 3/1984 Fed. Rep. of Germany .

*Primary Examiner*—Renee S. Luebke

*Attorney, Agent, or Firm*—Sughrue, Mion, Zinn, Macpeak & Seas

[57] ABSTRACT

A section switch has a pivoting blade connected to a first connector. The blade is provided with a contact hammer for engaging contact jaws connected to a second connector. The section switch includes a first contact finger fixed to a first spring and electrically connected to the second connector. A second contact finger is fixed to a second spring. The fingers come successively into contact during an opening operation of the section switch with an arcing horn that extends the hammer. The second finger and second spring are disposed so that the opening movement of the section switch causes ever-increasing amounts of energy to be stored in the second spring to cause the finger to rapidly escape from the arcing horn after a given opening stroke. The hammer is rotated about its axis to reduce contact force between the hammer and the jaws during opening of the section switch.

5 Claims, 5 Drawing Sheets

SECTION SWITCH THAT OPENS SUDDENLY

This application relates to U.S. application Ser. No. 07/863,233, filed Apr. 3, 1992, entitled "A SECTION SWITCH WITH IMPROVED CIRCUIT-BREAKING ABILITIES, IN PARTICULAR A SECTION SWITCH THAT OPENS VERTICALLY.

The present invention relates to high tension section switches. The description below relates to a section switch that opens vertically, but it will naturally be understood that the invention is equally applicable to other types of section switch, and in particular to grounding section switches.

BACKGROUND OF THE INVENTION

A vertically opening section switch comprises, in particular, a pivoting blade which is electrically connected at one end to a first connector disposed at the top of a first insulating column, the second end of said blade carrying a hammer that co-operates with a jaw which is electrically connected to a second connector disposed at the top of a second insulating column.

Such a section switch has little or no circuit-breaking ability.

An object of the present invention is to define a section switch having genuine circuit-breaking ability, for example making it possible to perform about 100 opening operations at 450 kV and 1600 A or a few operations at 730 kV and 2600 A without destroying the main contacts (jaw and blade).

U.S. Pat. No. 2 897 323 describes a section switch and circuit breaker assembly in which the section switch comprises an arcing horn including a rod that co-operates with a small wheel. That apparatus cannot operate when placed in weather conditions that are humid and cold since the wheel and the rods become covered in ice. The relative motion of the wheel and of the ice cannot ensure that the ice is broken since the mechanism operates in compression. It should be observed that breaking ice in compression requires considerable force.

Another object of the present invention is to provide a high tension section switch capable of operating under severe weather conditions.

Most high tension section switches suffer from the drawback of possessing arcing horns that radiate electromagnetically, thereby generating radiofrequency emissions that may interfere with normal radio transmissions.

Another object of the invention is to provide a section switch that does not generate radio interference.

Another object of the invention is to provide a section switch that is cheap in structure.

SUMMARY OF THE INVENTION

All of the above objects are achieved by a high tension section switch of the invention comprising a pivoting blade connected to a first connector, the blade being provided with a contact hammer for co-operating with contact jaws connected to a second connector, wherein the section switch includes a first contact finger fixed to a first spring and electrically connected to said second connector, a second contact finger fixed to a second spring and electrically connected to said second connector, said fingers being suitable for coming successively into contact during an opening operation of said section switch with an arcing horn that extends said hammer. The second finger and second spring are disposed so that the opening movement of the section switch causes ever-increasing amounts of energy to be stored in said second spring and causes said second finger to escape from the arcing horn after a given opening stroke. The fingers are disposed perpendicularly to the blade and electrical contacts between the first finger and the arcing horn take place while the section switch is in its closed position via the bottom portion of the arcing horn.

In a particular embodiment in which the section switch is of the type in which an opening operation begins with the hammer rotating about its own axis, thereby reducing or eliminating the contact force between said hammer and said jaw, said first finger and said first spring are disposed in such a manner that during said reduction or elimination, said first finger is in contact with said arcing horn. The first spring provides sufficient contact pressure until the arcing horn comes into contact with said second finger with sufficient force.

Preferably, the arcing horn is removable and is made of silver-plated copper.

The contact fingers, the springs, and the spring supporting rods are all made of stainless steel, for example.

BRIEF DESCRIPTION OF THE DRAWINGS

An embodiment of the invention is described by way of example with reference to the accompanying drawings, in which.

DETAILED DESCRIPTION

Figure 1:
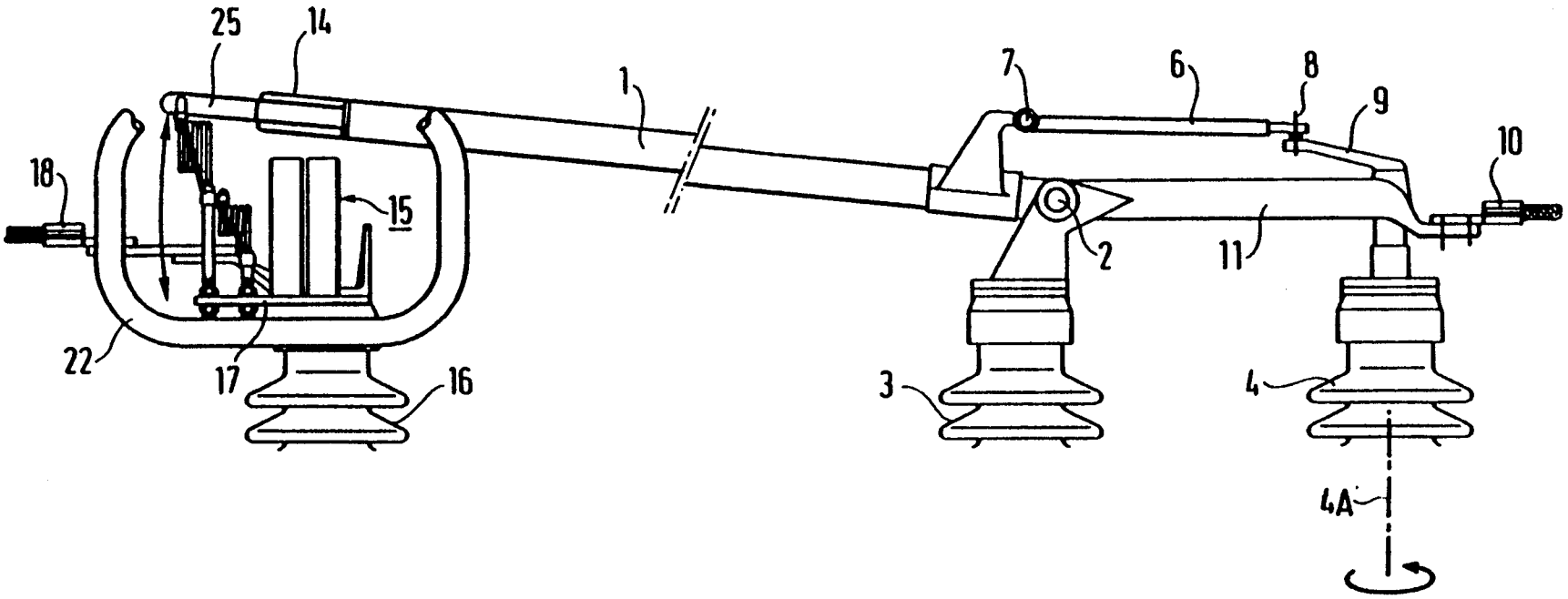
FIG. 1 is a fragmentary elevation view of a vertically-opening section switch of the invention, shown during an opening operation.

In FIG. 1, reference 1 designates a metal blade that pivots in a vertical plane about an axis 2 placed at the end of a first insulating column 3 represented in the drawing solely by its top end. The blade is moved by a rotary column 4 provided with a mechanism (not shown) enabling it to rotate about its axis 4A. Rotary motion is transmitted from the column to the blade 1 by rodding 6 hinged at one end to a ball-and-socket joint 7 on the blade 1 and hinged at its opposite end about an axis 8 to a crank arm 9 secured to the pivoting column 4.

The blade 1 is electrically connected to a first connector 10 by a metal part 11 that serves as a pivot for the pin on axis 2.

Figure 2:
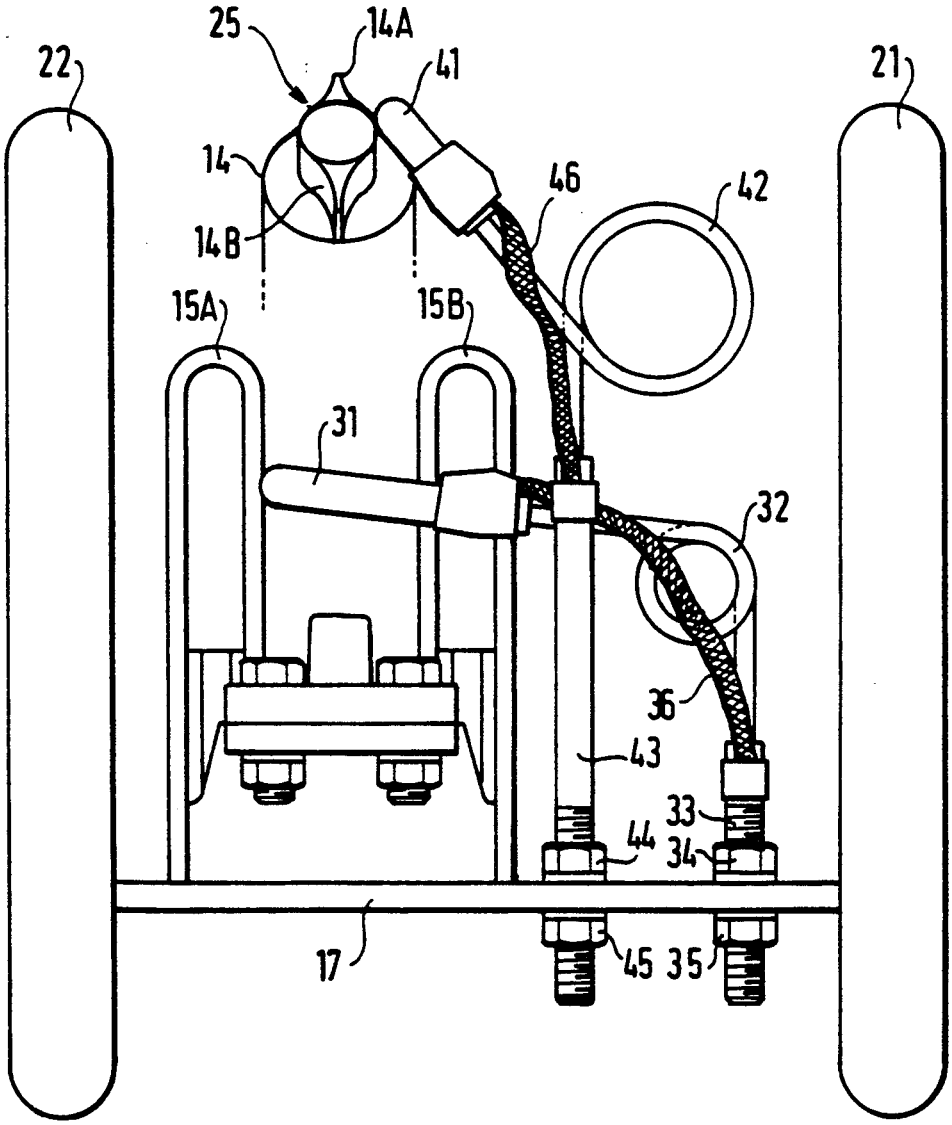
FIG. 2 is an end view of the same section switch shown at the same operating instant as in FIG. 1.

The blade 1 constitutes the moving contact of the section switch and its end furthest from the axis 2 carries a contact hammer 14 which engages with jaws 15 that constitute the fixed contact of the section switch and carried by a second insulating column 16. The hammer 14 may carry two opposite projections 14A and 14B, FIG. 2, which make it possible, when the section switch is in its closed position, to obtain very tight contact with the jaws by rotating the blade through 90° about its axis, and conversely, to obtain contact with reduced force or even with no force prior to such rotation. The means for rotating the blade are not shown, since they are well known to the person skilled in the art and do not form part of the present invention.

The jaw comprises two rows 15A and 15B of contact pieces, each comprising a curved blade which is fixed to a jaw support 17. The jaw support is electrically connected to a second connector 18. References 21 and 22 designate anticorona rings at the potential of the second connector.

According to the invention, the hammer 14 is extended by a metal piece, referred to as an arcing horn and referenced 25. This arcing horn co-operates in a manner described below with two arcing contacts or fingers 31 and 41 that are now described.

Figure 3:
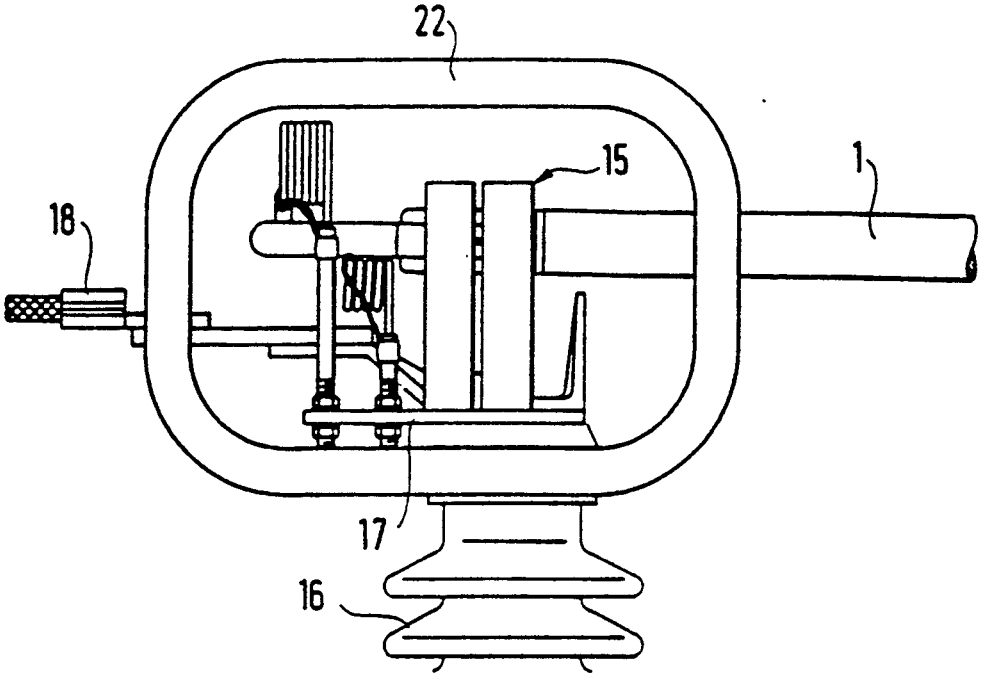
FIG. 3 is an elevation view of the same section switch in the closed position.
Figure 5:
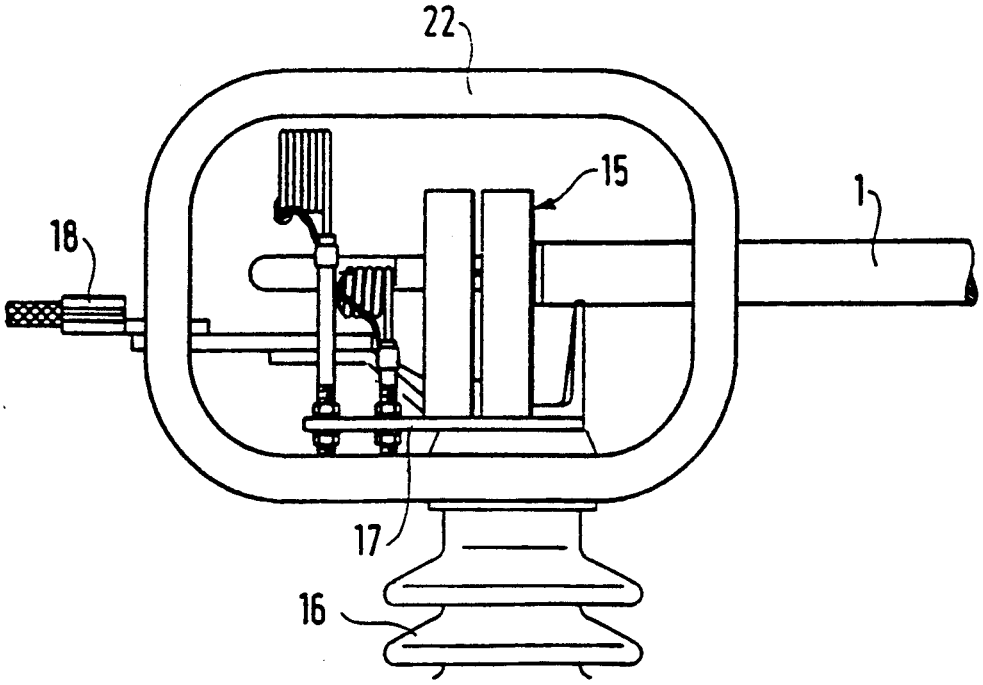
FIG. 5 is an elevation view of the same section switch while opening, in a position between the positions shown in FIGS. 1 and 3.
Figure 4:
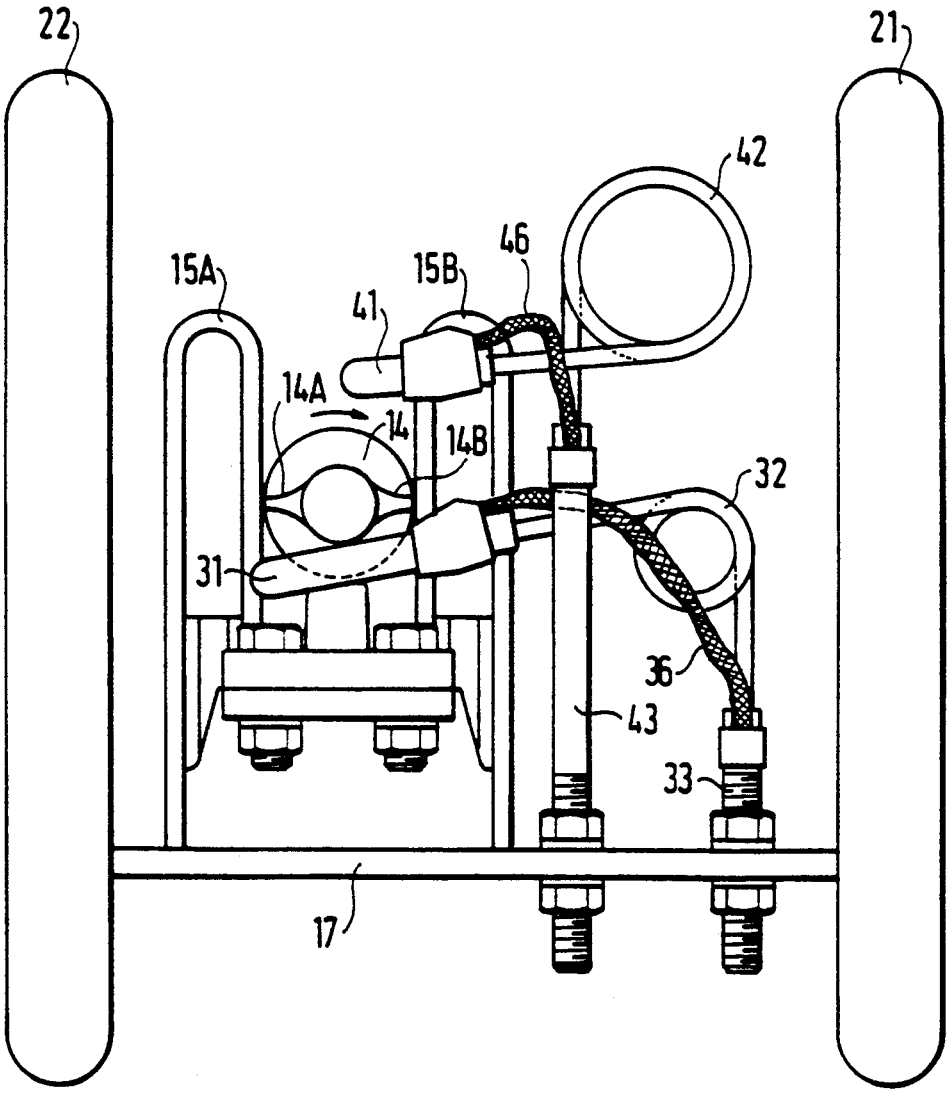
FIG. 4 is an end view of the same section switch in the closed position.

Arcing contact 31 is a metal piece disposed at the end of a support constituted in the form of a spring 32 having a plurality of turns and mechanically fixed to the jaw support 17 by means of a threaded rod 33 and nuts 34 and 35. A metal braid 36 ensures good electrical contact between the contact 1 and the jaw support. The spring 32 is adjusted so that the contact 31 is substantially horizontal when it is not in contact with the arcing horn 25. The arcing contact 31 is disposed in such a manner, that when the section switch is in its closed position (FIGS. 3 and 4), the arcing horn pushes the contact 31 downwards against the action of the spring. It may be observed that the contact 31 makes contact with the bottom portion of the arcing horn 25 and is therefore protected from ice. Electrical contact is thus always ensured, when applying a force of several kilograms due to the spring 32.

The arcing contact 41 is a metal piece placed at the end of a support in the form of a spring 42 having a plurality of turns and mechanically fixed to the jaw support 17 by means of a threaded rod 43 and nuts 44 and 45. A metal braid 46 ensures good electrical contact between the contact 41 and the jaw support. The spring 42 is adjusted so that the contact 41 is substantially horizontal when not in contact with the arcing horn 25. The arcing contact 41 is disposed in such a manner that when the section switch is in the closed position (FIGS. 3 and 4), it lies above the arcing horn and does not make contact therewith.

The contacts 31 and 41 are offset from each other in the longitudinal direction of the arcing horn.

The section switch operates as follows:

1. Opening operation

Figure 6:
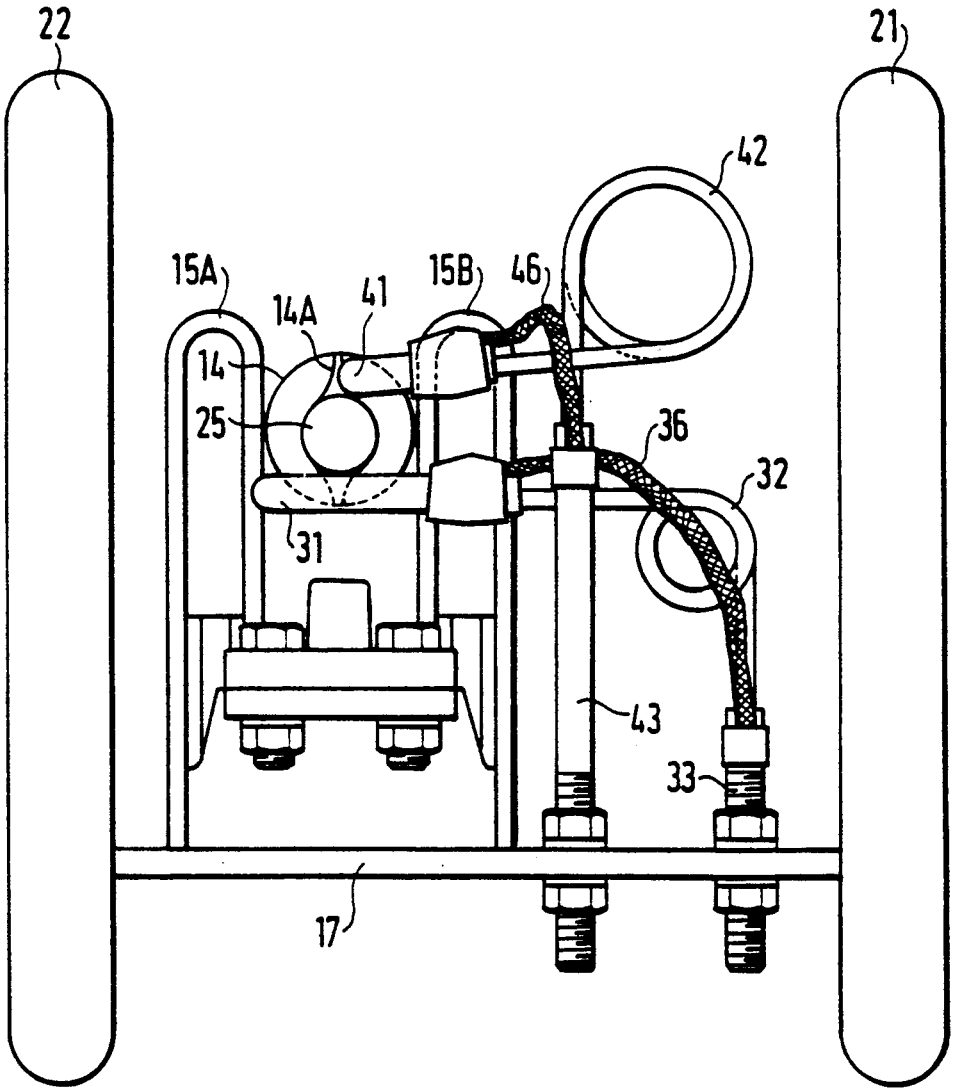
FIG. 6 is an end view of the same section switch at the same operating instant as that shown in FIG. 5.

In the closed position (FIGS. 3 and 4), current passes through the connector along the following path: connector 18, jaws 15, hammer 14, blade 1, pivot 11, and connector 10. The section switch opens initially by rotating through 90° about the longitudinal axis of the blade, thereby separating the hammer from the contact fingers. Electricity is then diverted via the arcing horn 25 which is in contact with the contact finger 31 pressed thereagainst by the spring 32 (FIG. 6). The spring 32 is capable of exerting a contact force of about 40N, which is sufficient for enabling electrical current to pass. As explained above, electrical contact between the parts 31 and 25 is always possible because it takes place via the bottom portion of the arcing horn 25, i.e. via a portion that is protected from ice. When the hammer rotates, the contact 31 breaks any ice that may be found on the side of the arcing horn, and this is made easier by the contact 31 operating in shear and not in compression. Electrical contact continues to be provided between the parts 31 and 25 so long as they remain in mechanical contact.

Once it has finished rotating, the hammer 14 begins to be raised. While still in contact with the finger 31 due to the action of the spring 32, the horn 14 comes into contact with the finger 41. Contact between the horn 25 and the finger 41 takes place via the bottom portion of the finger which is therefore relatively protected from ice.

As it continues to move upwards, the arcing horn 25 looses contact from the finger 31, but current continues to pass via the finger 41. The finger 41 is driven by the arcing horn as it continues to move (FIG. 2) with the increasing force being applied to the spring 42; the finger 41 the escapes suddenly from the horn 25, with this escape being sudden because of the force previously applied to the spring.

As a result, the circuit-breaking arc is rapidly extinguished because an adequate isolating distance is obtained very quickly. There is no danger of restriking and wear of the parts is limited.

Advantageously, the arcing horn which is made of silver-plated copper is removable so that it can easily be replaced.

The contact fingers 31 and 41, the springs 32 and 42 and the rods 33 and 43 supporting the springs are preferably made of stainless steel.

By having the fingers 31 and 41 extending in planes that are substantially perpendicular to the plane in which the section switch blade moves, it is possible at tensions greater than 230 kV to direct magnetic coronas towards the anticorona rings 21 and 22, thereby reducing the risk of radio interference.

Closing operation

The above operations are performed in the opposite order. As the blade 1 moves downwards, the arcing horn comes into contact with the finger 41, thereafter said finger escapes from the arcing horn after the horn has already made contact with the finger 31. The rotation of the hammer allows the horn 25 to scrape the finger 31, thereby ensuring good electrical contact for a subsequent circuit-breaking operation.

The invention is applicable to high tension section switches.

I claim:

1. A section switch comprising a pivoting blade connected to a first connector, the blade being provided with a contact hammer for engaging with contact jaws connected to a second connector, wherein the section switch includes a first contact finger fixed to a first spring and electrically connected to said second connector, a second contact finger fixed to a second spring and electrically connected to said second connector, said fingers being positioned to come successively into contact during an opening operation of said section switch with an arcing horn that extends said hammer, said second finger and second spring being disposed so that the opening movement of the section switch causes ever-increasing amounts of energy to be stored in said second spring and causing said second finger to escape from the arcing horn after a given opening stroke of the blade, the fingers being disposed perpendicularly to the blade, and wherein electrical contacts between the first finger and the arcing horn take place while the section switch is in its closed position via the bottom portion of the arcing horn.

2. A section switch according to claim 1, further comprising means for rotating said hammer about the blade axis, and wherein an opening operation begins with the hammer rotating about its own axis, thereby reducing the contact force between said hammer and said jaws, said first finger and said first spring are disposed in such a manner that during said reduction, said first finger is in contact with said arcing horn, said first spring providing sufficient contact pressure until the arcing horn comes into contact with said second finger with sufficient force.

3. A section switch according to claim 1, wherein the arcing horn is removable.

4. A section switch according to claim 1, wherein the arcing horn is made of silver-plated copper.

5. A section switch according to claim 1, further including spring supporting rods supporting said springs, and wherein the contact fingers, the springs, and the spring supporting rods are all made of stainless steel.

* * * * *